US005139084A

United States Patent [19]

Gentry

[11] Patent Number: 5,139,084

[45] Date of Patent: Aug. 18, 1992

[54] ROD BAFFLE HEAT EXCHANGER

[75] Inventor: Cecil G. Gentry, Bartlesville, Okla.

[73] Assignee: Phillips Petroleum Company, Bartlesville, Okla.

[21] Appl. No.: 673,617

[22] Filed: Mar. 22, 1991

[51] Int. Cl.[5] ..... F28F 9/00

[52] U.S. Cl. ..... 165/162; 122/510

[58] Field of Search ..... 165/162, 69; 122/510

[56] References Cited

U.S. PATENT DOCUMENTS

| | | | |
|---|---|---|---|
| 4,281,452 | 8/1981 | Kolosov et al. | 29/623.1 |
| 4,286,366 | 9/1981 | Vinyard | 29/157.4 |
| 4,311,187 | 1/1982 | Small | 165/1 |
| 4,342,360 | 8/1982 | Gentry et al. | 165/67 |
| 4,640,342 | 2/1987 | Appleman | 165/69 |
| 4,697,637 | 10/1987 | Young | 165/160 |
| 4,813,117 | 3/1989 | Wepfer et al. | 29/157.4 |
| 4,874,041 | 10/1989 | Crick et al. | 165/162 |
| 4,917,172 | 4/1990 | Falduti | 165/1 |
| 4,991,645 | 2/1991 | Lagally et al. | 165/69 |

OTHER PUBLICATIONS

*Engineering Tolerances* by H. G. Conway, c. 1948 by Isaac Pittman & Sons, London pp. 50–59.

*Primary Examiner*—Allen J. Flanigan
*Attorney, Agent, or Firm*—David L. Kinsinger

[57] ABSTRACT

An improved rod baffle heat exchanger and method for manufacturing the same are disclosed in which the tube bundle thereof comprises a plurality of tubes supported intermediate their ends by at least one outer ring and a plurality of baffle rods carried by the outer ring and extending between parallel tube rows. The baffle rods comprise circular standard rods and circular substitute rods wherein the diameter of the substitute rods differs from that of the standard rods. The use of different sized circular rods allows firm contact to be achieved between the rods and tubes of the tube bundle in order to avoid tube vibration while also avoiding the problems of rod-to-tube tolerance buildup.

4 Claims, 6 Drawing Sheets

ROD BAFFLE HEAT EXCHANGER

BACKGROUND OF THE INVENTION

The present invention relates generally to heat exchangers, and more particularly, but not by way of limitation, to rod baffle heat exchangers.

Various rod baffle heat exchangers have been disclosed in the art. Several of these heat exchangers have been put into successful, practical application. One of the continuing problems in these heat exchangers is to establish a firm contact between the rods and the heat exchanger tubes while avoiding rod-to-tube tolerance buildup problems. With rod baffle heat exchangers ever increasing in size, inserting tubes in baffle cage assemblies having a large rod-to-tube tolerance buildup becomes increasingly difficult. One proposal to solve this problem was to provide rods with areas of varying cross section and slide the rods so that an area of the rod having a small cross section is replaced by an area of a rod having a larger cross section between the tubes, whereby the area of the rod with larger cross section is urged into firm contact with the tubes. Another proposal to solve this problem was to use rods having elliptical cross sections therefore allowing easy assembly and firm engagement of the rods and the tubes by simple rotation of the rods about their longitudinal axes.

SUMMARY OF THE INVENTION

It is one object of this invention to provide a rod baffle useful for heat exchangers with simple rods having circular cross sections that will allow firm contact between the rods and the tubes while avoiding positive tolerance buildup between rods and tubes.

Another object of this invention is to provide a heat exchanger incorporating such rod baffles.

A further object of this invention is to provide an improved method for manufacturing heat exchangers.

In accordance with this invention, there is provided a rod baffle having standard rods with circular cross sections and substitute rods with circular cross sections to provide firm engagement of such rods with heat exchanger tubes and avoid positive tolerance buildup between rods and tubes. In accordance with another aspect of this invention, there is provided a heat exchanger having rod baffles comprising standard rods and substitute rods to avoid positive tolerance buildup between rods and tubes. In accordance with another aspect of this invention, a process is provided for producing heat exchangers wherein rod baffles are used comprising standard rods and substitute rods so that tubes can be easily inserted into baffle cage assemblies while firm contact between the rods and the heat exchanger tubes is maintained.

DETAILED DESCRIPTION OF THE INVENTION

Figure 1:
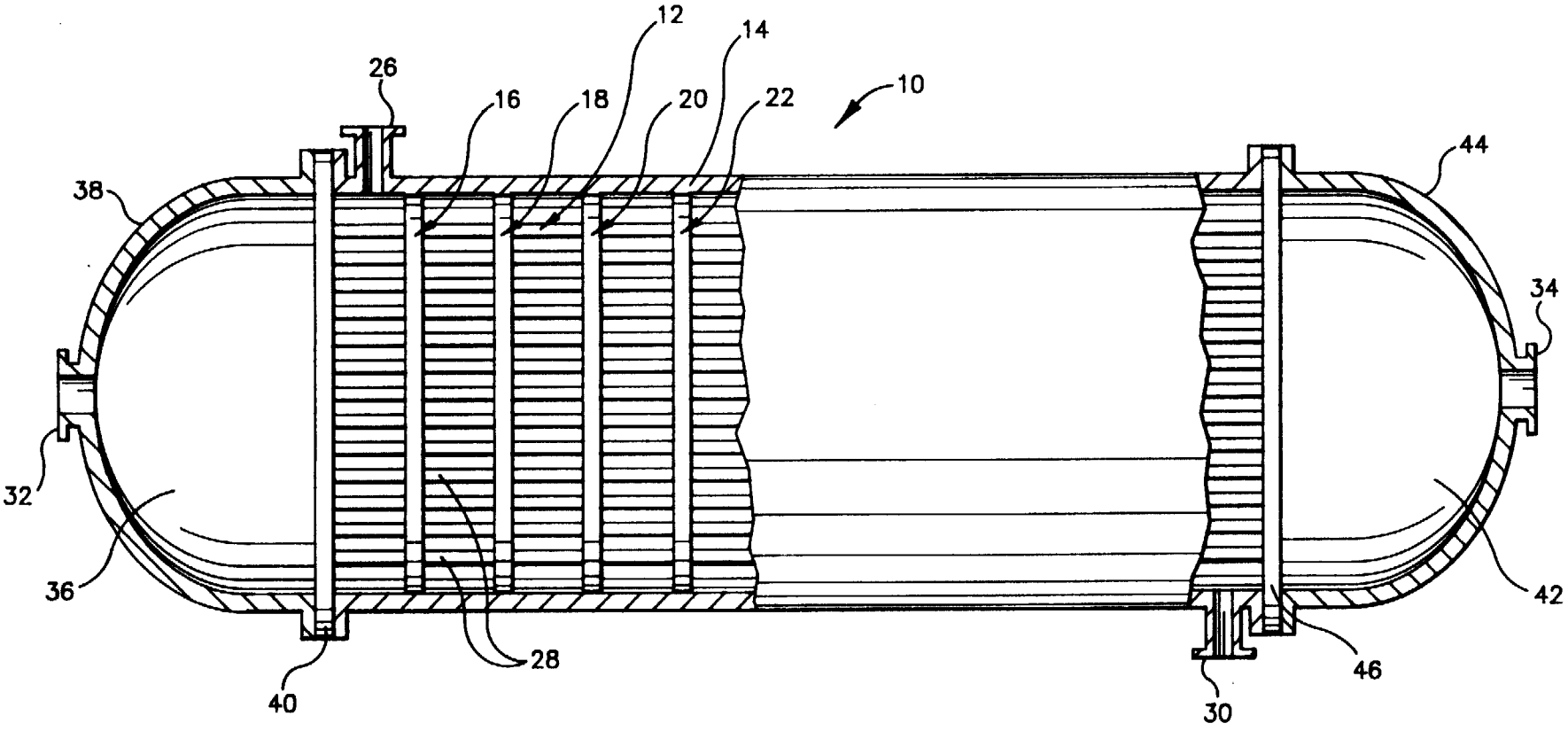
FIG. 1 is a side elevation view of a shell and tube heat exchanger constructed in accordance with the invention with portions of the shell broken away to more clearly illustrate the internal structure.

Referring now to the drawings, and to FIG. 1 in particular, there is illustrated a shell and tube heat exchanger 10. A rod baffle tube bundle 12 is surrounded by shell 14. The tubes in the tube bundle 12 are supported by a plurality of rod baffle assemblies 16, 18, 20, and 22. One fluid enters the shell side of the shell and tube heat exchanger 10 through an inlet 26 and after heat exchange with the fluid in the tubes 28 leaves the shell side via outlet 30. The fluid flowing through the tube side of the heat exchanger enters the end cap 38 of the heat exchanger via inlet 32 and leaves the end cap 44 of the heat exchanger via outlet 34. This fluid flows from end chamber 36 which is defined by the end cap 38 of the heat exchanger and the tube sheet 40 through the tubes 28 and into the opposite end chamber 42 which is similarly confined by the end cap 44 and the other tube sheet 46.

The tubes 28 can be arranged in a square pattern as shown in FIGS. 3–6. The tubes 28 are kept in position by a plurality of rod baffle assemblies 16, 18, 20, and 22. These rod baffle assemblies, as shown in more detail in FIGS. 2–6, each comprise a plurality of circular standard rods 48 and a plurality of circular substitute rods 50. The substitute rods 50 will either comprise undersized rods or oversized rods depending upon the particular needs of the tube bundle. These rods are rigidly attached, e.g., by welding, to an outer ring 52.

Figure 3:
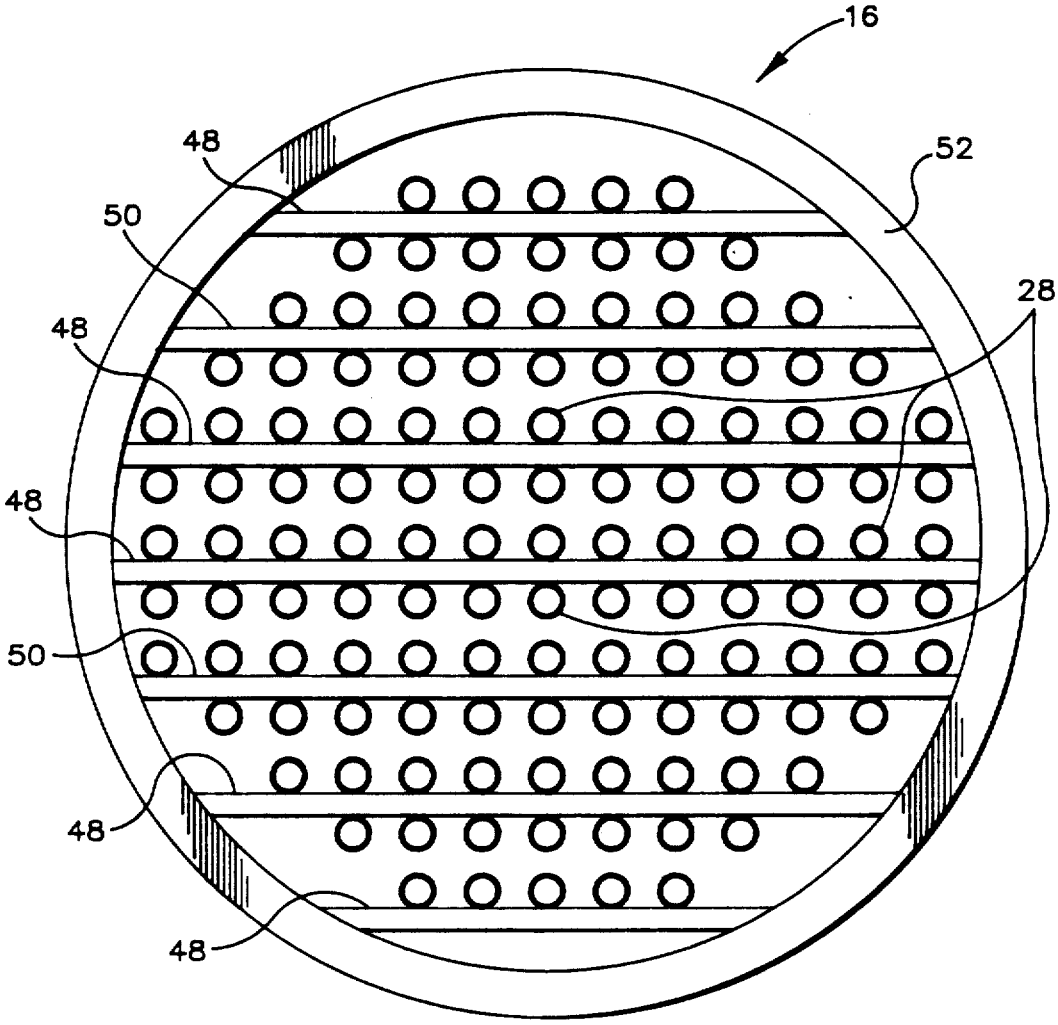
FIG. 3 is a cross-sectional view taken along line 3—3 of FIG. 2.

The construction of the rod baffle assembly 16 is more clearly illustrated in FIG. 3. The baffle 16 comprises a plurality of horizontally extending baffle rods comprising standard rods 48 and substitute rods 50 that are fixedly secured at their opposite ends in the outer ring 52 and are evenly spaced so that they extend between alternate pairs of the horizontal, parallel rows of tubes 28.

Figure 4:
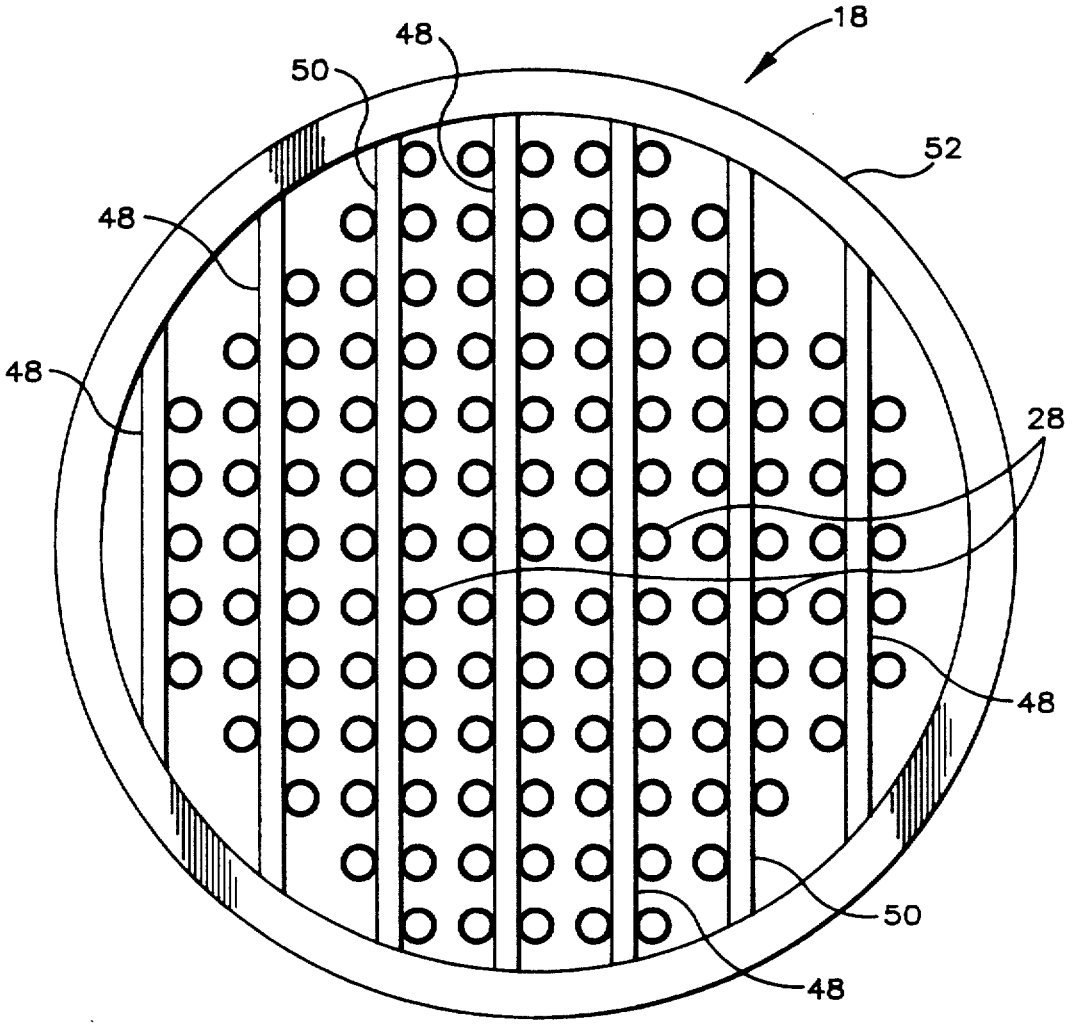
FIG. 4 is a cross-sectional view taken along line 4—4 of FIG. 2.

The construction of the rod baffle assembly 18 is more clearly illustrated in FIG. 4. The baffle assembly 18 comprises a plurality of vertically extending baffle rods comprising standard rods 48 and substitute rods 50 that are fixedly secured at their opposite ends in the outer ring 52 and are evenly spaced so that they extend between alternate pairs of vertical, parallel rows of tubes 28.

Figure 5:
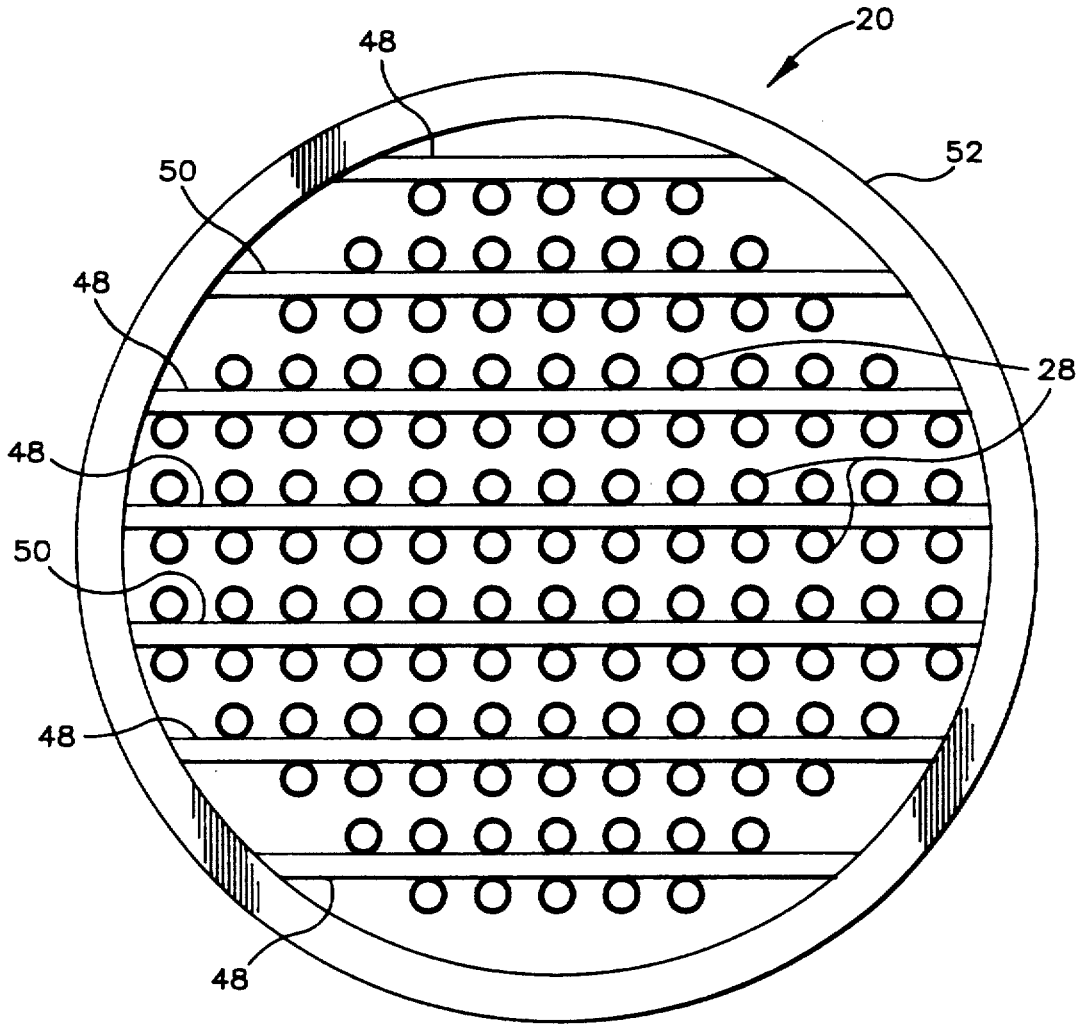
FIG. 5 is a cross-sectional view taken along line 5—5 of FIG. 2.

The construction of the rod baffle assembly 20 is more clearly illustrated in FIG. 5. The baffle assembly 20 comprises a plurality of horizontally extending baffle rods comprising standard rods 48 and substitute rods 50 that are fixedly secured at their opposite ends in the outer ring 52 and are evenly spaced so as to extend between alternate pairs of horizontal, parallel rows of tubes 28. It will be noted, however, that the rows of tubes 28 between which the rods of rod baffle assembly 20 extend are not the rows of tubes 28 between which the rods of the rod baffle assembly 16 extend. The rods of rod baffle assembly 20 are positioned between horizontal tube rows which are open or unbaffled in the rod baffle assembly 16.

Figure 6:
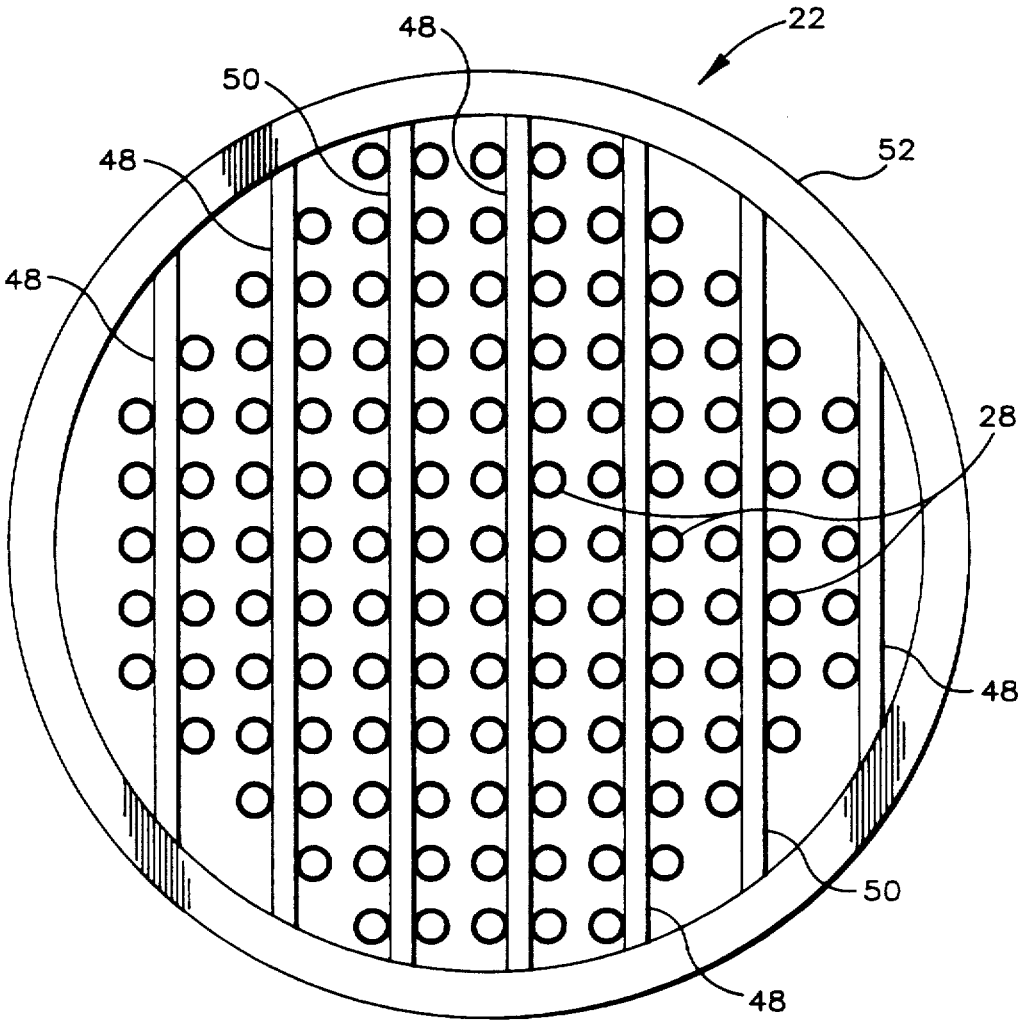
FIG. 6 is a cross-sectional view taken along line 6—6 of FIG. 2.

The construction of the rod baffle assembly 22 is more clearly illustrated in FIG. 6. The baffle assembly 22 comprises a plurality of vertically extending baffle rods comprising standard rods 48 and substitute rods 50 that are fixedly secured at their opposite ends in the outer ring 52 and extend between alternate pairs of vertical, parallel rows of tubes 28. It will be noted, however, that the tube rows between which the rods of the rod baffle assembly 22 extend are not the tube rows between which the rods of rod baffle assembly 18 extend. The rods of rod baffle assembly 22 are positioned between vertical tube rows which are opened or unbaffled in the baffle assembly 18.

Figure 2:
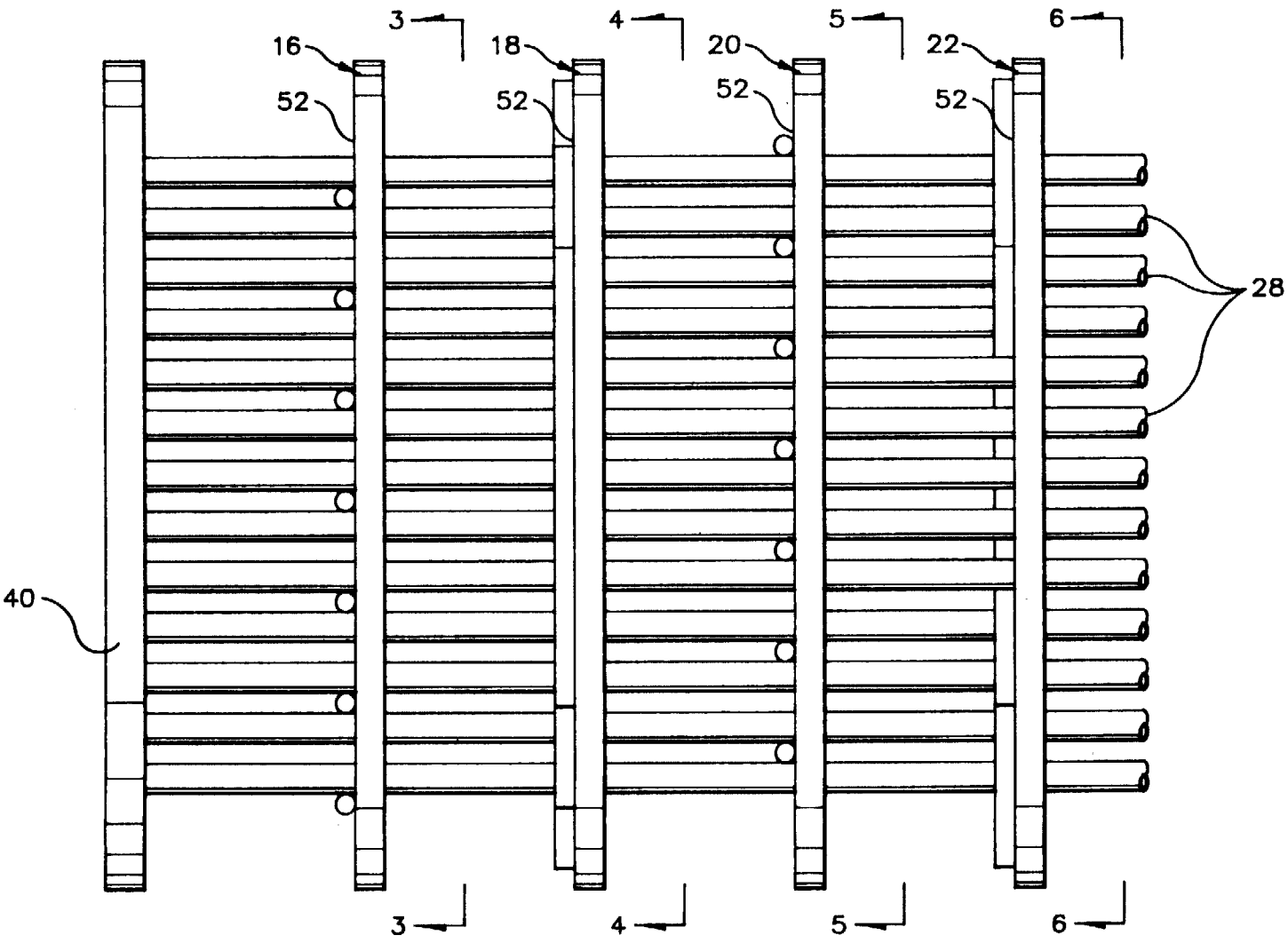
FIG. 2 is an enlarged partial side elevation view more clearly illustrating the tube bundle employed in the embodiment of FIG. 1.

The four baffle set comprising baffle assemblies 16, 18, 20 and 22 is shown in FIG. 2. FIG. 2 shows a plurality of tubes 28 extending from the tube sheet 40 through the first rod baffle assembly 16, the second rod baffle assembly 18, the third rod baffle assembly 20 and the fourth rod baffle assembly 22. Rod baffle assemblies 16 and 20 contain horizontal rods while rod baffle assemblies 18 and 22 contain vertical rods, as previously disclosed. The four baffles together provide radial support on four sides of each tube 28.

A tube bundle constructed in accordance with the present invention can typically include multiple baffle sets such as those shown in FIG. 2. The baffle assemblies in any embodiment of the invention can be positioned in a plane which is not perpendicular to the longitudinal axis of the tubes as well as in a plane which is perpendicular to said axis. It is presently preferred to construct the support apparatus of the invention using baffle assemblies which are positioned in a plane perpendicular to the longitudinal axis of the tubes because the outer rings 52 can be circular in shape as opposed to the more difficult to construct elliptically shaped rings required for baffle assemblies positioned in a plane which is not perpendicular to the longitudinal axis of the tubes. Of course it will be understood that baffle assemblies positioned in a plane perpendicular to the longitudinal axis of the tubes as well as baffle assemblies positioned in a plane not perpendicular to said axis are within the scope of the present invention.

While the four baffle set shown in FIG. 2 is presently preferred, it is emphasized that a supporting apparatus in accordance with the present invention only requires that the rods in each baffle assembly inserted in the spaces between adjacent tube rows in one plurality of parallel tube rows are inserted into less than the total number of such spaces. It is immaterial whether the rods are inserted in adjacent spaces, alternate spaces, two adjacent spaces followed by skipping two spaces or any variation desired.

The minimum number of rods in a baffle assembly is the number sufficient for the baffle set to provide radial support for each tube forming the tube bundle. It is preferred that this functional limitation also be used to determine the maximum number of rods in a baffle assembly because the pressure drop across the shell side of a shell and tube heat exchanger is the lowest when the least number of rods are used to form the baffle assemblies; however, it is essential to use enough rods in each baffle assembly for the baffle set to provide radial support for each tube. The number of baffle assemblies constituting a baffle set as described above must not be confused with the total number of baffle assemblies used in the tube bundle as this latter number can be any number above the minimum number required in a baffle set and the total number of baffle assemblies in the tube bundle is otherwise independent of the number of baffle assemblies in a baffle set.

It is apparent that the minimum number of baffle assemblies per baffle set is dependent upon the tube layout. While FIGS. 3–6 show a square pitch tube layout, other tube layouts are possible in which the minimum number of baffle assemblies in a baffle set may be other than those specifically discussed. But with any tube layout, at least three baffle assemblies per baffle set are required to practice the present invention and the specific tube layouts herein discussed are presented for the purposes of illustration and are not intended to limit the broad invention.

The standard rods 48 of each baffle assembly are sized and shaped to ensure a tight fit between all rods and tubes within the tube bundle. The desired standard rod 48 diameter, therefore, is determined based upon the tube pitch design pattern and tube diameter. For example, a tube bundle having a 2.00 inch square pitch design and having 1.50 inch diameter tubes would require 0.50 inch diameter rods to ensure a tight fit between rods and tubes within the tube bundle. If the standard rods have a smaller diameter, a tight fit will not be achieved and tube vibration can result. If the standards rods have a larger diameter, difficulty in inserting the tubes through all of the baffle assemblies of the tube bundle will result.

Although an exact standard rod diameter is desirable to obtain the proper tight fit within the tube bundle, such an exact standard rod diameter is not always possible. The actual standard rod diameter will vary slightly depending upon rod material, processing conditions and finish.

The "rod tolerance" shall be defined as the difference between the average actual standard rod diameter and the desired standard rod diameter. The average actual standard rod diameter can be determined by measuring a random sample of standard rods from the total supply of standard rods that are used to construct the baffle assemblies.

Likewise, an exact tube diameter is also desired to ensure a tight fit between rods and tubes, however, such an exact tube diameter is also not always possible. The actual tube diameter will vary slightly depending upon tube material, processing conditions and finish.

The "tube tolerance" shall be defined as the difference between the average actual tube diameter and the desired tube diameter. The average actual tube diameter can be determined by measuring a random sample of tubes from the total supply of tubes that are used to construct the tube bundle.

The "total tolerance" shall be defined as the sum of the "rod tolerance" and the "tube tolerance". A positive total tolerance indicates the need for undersized substitute rods to avoid positive rod-to-tube buildup problems. A negative total tolerance indicates the need for oversized substitute rods to ensure a tight fit between the rods and tubes of the tube bundle and avoid vibration problems.

The substitute rods used in each tube bundle shall have equal diameters. If a tube bundle has a positive total tolerance, the substitute rods comprise undersized rods. The undersized rods have equal diameter. This undersized rod diameter is less than the desired standard rod diameter.

In one embodiment of this invention, an undersized rod is positioned at every "N-th" rod location, with standard rods located at all other rod locations. The "N-th" rod location can be determined from the following relationship:

$$N = \frac{\text{(Average Actual Standard Rod Diameter} - \text{Undersized Rod Diameter)}}{\text{total tolerance}}$$

The number N determined from this relationship is rounded off to the nearest integer to determine the N-th rod location. This configuration will allow the rods to be closely received between the tubes of the adjacent horizontal and vertical tube rows, respectively, while not creating a positive rod-to-tube tolerance buildup problem.

If a tube bundle has a negative total tolerance, the substitute rods comprise oversized rods. The oversized rods have equal diameter. This oversized rod diameter is greater than the desired standard rod diameter.

In one embodiment of this invention, an oversized rod is positioned at every "N-th" rod location, with standard rods located at all other rod locations. The "N-th" rod location can be determined from the following relationship:

$$N = \frac{\text{(Average Actual Standard Rod Diameter} - \text{Oversized Rod Diameter)}}{\text{total tolerance}}$$

The number N determined from this relationship is rounded off to the nearest integer to determine the N-th rod location. This configuration will allow the rods to be closely received between the tubes of the adjacent horizontal and vertical tube rows and avoid vibration problems caused by a loose fit between rods and tubes.

To assemble the heat exchanger 10, the tubes 28 are inserted through the baffle assemblies 16, 18, 20, 22, etc. which are spaced apart as illustrated in FIG. 1. At this point the tubes 28 are supported by the baffle rods 48 and 50 of the baffle assemblies 16, 18, 20, and 22. Difficulty in inserting the tubes 28 through the baffle assemblies 16, 18, 20 and 22 is avoided due to the fact that no positive rod to tube tolerance buildup exists due to the use of the substitute rods 50 in each of the baffle assemblies. The ends of the tubes 28 are then received through the corresponding apertures formed in the tube sheets 40 and 46. When suitably positioned, the tubes 28 are fixedly secured to the tube sheets 40 and 46 with each end of each tube forming a fluid tight seal with the corresponding aperture in each tube sheet.

Alternatively, the first end of each tube 28 can be fixedly secured to the tube sheet 40 before insertion of the tubes 28 through the baffle assemblies with each first end of each tube 28 forming a fluid tight seal with the corresponding aperture in the tube sheet 40. After insertion of the tubes 28 through the baffle assemblies, the second ends of each tube 28 are fixedly secured to the tube sheet 46 with the second ends of each tube 28 forming a fluid tight seal with the corresponding aperture in the tube sheet 46.

The tube bundle 12 thus assembled is inserted into the open end of the shell 14 and properly positioned therein at which time the open ends of the shell 14 are closed by suitable end caps 38 and 44.

The following examples are given to illustrate construction and specifics of tube bundles employing representative embodiments of the present invention. The apparatuses described were not actually constructed, but are set forth as an aid for conveying a clear understanding of the present invention.

EXAMPLE I

A single pass shell and tube heat exchanger contains 4,009 carbon steel tubes, with a 1.5 inch (3.81 cm) outside diameter with a +0.006 inch (+0.015 cm) tolerance, laid out on a square pitch of 2.00 inches (5.08 cm).

The baffle arrangement is as illustrated in FIG. 2. Four baffle assemblies per baffle set are employed. The supportive rods have a circular cross-section and a diameter of 0.500 inches (1.27 cm). The rods are welded by their ends as cords to an end of a circular outer ring having an inside diameter of 144 inches (365 cm). Each baffle assembly contains 36 substantially parallel, evenly spaced rods. The rods in each baffle assembly are positioned in approximately 50 percent of the spaces between adjacent tube rows in one plurality of parallel tube rows. The four baffle assemblies of each baffle set are oriented as shown in FIG. 2 so as to provide radial support for each tube in the tube bundle.

After the rod baffle orientation is complete, the tubes are then inserted into the bundle. As more tubes are added to the bundle, it becomes increasingly difficult to add additional tubes because of the positive rod-to-tube tolerance buildup that occurs. Because of the positive tolerance of the tubes utilized in the present example, there could be as much as 0.426 inches (1.08 cm) positive tolerance buildup between rods and tubes over the entire bundle diameter.

EXAMPLE II

A single pass shell and tube heat exchanger contains 4,009 carbon steel tubes, with a 1.5 inch (3.81 cm) outside diameter with a +0.006 inch (+0.015 cm) tolerance, laid out on a square pitch of 2.00 inches (5.08 cm), as described in Example I.

The baffle arrangement is as described in Example I, except that two types of supportive rods are used in each baffle assembly. Standard rods are used having a diameter of 0.500 inches (1.27 cm) and having +0.000 inch (+0.000 cm) tolerance. Also, undersized rods are used having a diameter of 0.4724 inches (1.200 cm). The location of the undersized rods in each baffle is determined from the following relationship:

$$N\text{-th row} = \frac{\text{(Average Actual Standard Rod Diameter} - \text{Undersized Rod Diameter)}}{\text{total tolerance}}$$

For this example, N-th row=(0.500−0.4724)/0.006=4.6. N is then rounded off to the nearest integer, which is 5. Based on this result, every fifth rod of each rod baffle will comprise an undersized rod while the remaining rods will comprise standard rods.

After the rod baffle orientation is complete, the tubes are then inserted into the bundle. As more tubes are added to the bundle, it will not become increasingly difficult to add additional tubes, as it was in Example I, because the positive rod-to-tube tolerance buildup has been decreased by the use of the undersized rods.

EXAMPLE III

A single pass shell and tube heat exchanger contains 4,009 carbon steel tubes, with a 1.5 inch (3.81 cm) outside diameter with a −0.006 inch (−0.015 cm) tolerance, laid out on a square pitch of 2.00 inches (5.08 cm).

The baffle arrangement is as described in Example I. After the rod baffle orientation is completed as in Example I, the tubes are inserted into the bundle. After all of the tubes have been added to the bundle, the desired tight fit amongst the tubes within the bundle is not achieved because of the negative rod-to-tube tolerance buildup that occurs. Because of the negative tolerance of the tubes utilized in the present example, there could be as much as 0.426 inches (1.08 cm) negative tolerance buildup between rods and tubes over the entire bundle diameter. It is important to create a tight fit between the tubes and rods of the tube bundle in order to avoid vibration problems.

EXAMPLE IV

A single pass shell and tube heat exchanger contains 4,009 carbon steel tubes, with a 1.5 inch (3.81 cm) outside diameter with a −0.006 inch (−0.015 cm) tolerance, laid out on a square pitch of 2.00 inches (5.08 cm), as described in Example III.

The baffle arrangement is as described in Example III, except that two types of supportive rods are used in each baffle assembly. Standard rods are used having a diameter of 0.500 inches (1.27 cm) and having +0.000 inch (+0.000 cm) tolerance. Also, oversized rods are used having a diameter of 0.5118 inches (1.3 cm). The location of the oversized rods in each baffle is determined from the following relationship:

$$N\text{-th row} = \frac{(\text{Average Actual Standard Rod Diameter} - \text{Oversized Rod Diameter})}{\text{total tolerance}}$$

For this example, N-th row=(0.500−0.5118)/−0.006=1.97. N is then rounded off to the nearest integer, which is 2. Based on this result, every second rod of each rod baffle will comprise an oversized rod while the remaining rods will comprise standard rods.

After the baffle orientation is complete, the tubes are then inserted into the bundle. After all of the tubes are added to the bundle, a tight fit between rods and tubes will be ensured as a result of the utilization of the oversized rods. Because of the utilization of the oversized rods, there could only be as much as 0.0008 inches (0.0020 cm) negative tolerance buildup between rods and tubes over the entire bundle diameter.

It will be seen that the method and apparatus described above provides advantages in the construction of shell and tube heat exchangers. The method and apparatus described above results in increased ease of assembly of this structure as a result of decreased positive tolerance buildup between rods and tubes. Also, the method and apparatus described above results in reliable firm engagement of the tubes of the structure intermediate their opposite ends as a result of the decrease in negative tolerance buildup between the rods and tubes.

Reasonable variations and modifications which will be apparent to those skilled in the art can be made in this invention without parting from the spirit and scope thereof.

That which is claimed is:

1. An apparatus comprising:

a plurality of parallel tubes arranged to form a plurality of parallel rows of tubes wherein each said tube has the same desired tube diameter and each said tube has an actual tube diameter and wherein the tube tolerance is defined as the desired tube diameter subtracted from the average actual tube diameter;

at least one outer ring surrounding said plurality of tubes in a plane about normal to said plurality of tubes; and a plurality of rods having first and second ends wherein each said rod is fixedly secured at its first and second end to one of said outer rings so that each said outer ring has a plurality of said rods secured thereto in a parallel equally spaced relation wherein each of said rods extends between two adjacent rows of said tubes so as to be in supportive contact with each said tube of the two adjacent rows, wherein said rods comprise standard rods and substitute rods wherein each said standard rod has the same desired standard rod diameter and each said standard rod has an actual standard rod diameter wherein the standard rod tolerance is defined as the desired standard rod diameter subtracted from the average actual standard rod diameter, and each said substitute rod has approximately the same substitute rod diameter, and wherein the substitute rod diameter is not equal to the desired standard rod diameter and wherein the difference between each said substitute rod diameter and each said standard rod desired diameter is substantially greater than said standard rod tolerance.

2. An apparatus in accordance with claim 1, having a total tolerance defined as the sum of the tube tolerance and the standard rod tolerance, wherein, when the total tolerance is a positive number, said substitute rods comprise undersized rods wherein the actual diameter of said undersized rods is less than the desired diameter of said standard rods and, alternately, wherein, when the total tolerance is a negative number, said substitute rods comprise oversized rods wherein the actual diameter of said oversized rods is greater than the desired diameter of said standard rods.

3. The apparatus of claim 2, wherein, when the total tolerance is a positive number, every N-th rod of said plurality of rods comprises one of said undersized rods and all remaining rods comprise said standard rods wherein N is determined by the formula $$N = \frac{(\text{Average Actual Standard Rod Diameter} - \text{Undersized Rod Diameter})}{\text{total tolerance}}$$

wherein N is rounded off to the nearest integer and, alternately, wherein, when the total tolerance is a negative number, every N-th rod of said plurality of rods comprises one of said oversized rods and all remaining rods comprise said standard rods, wherein N is determined by the formula $$N = \frac{(\text{Average Actual Standard Rod Diameter} - \text{Oversized Rod Diameter})}{\text{total tolerance}}$$

wherein N is rounded off to the nearest integer.

4. An apparatus comprising:

a plurality of parallel tubes arranged to form a plurality of parallel rows of tubes wherein each said tube has the same desired tube diameter and each said tube has an actual tube diameter wherein the tube tolerance is defined as the desired tube diameter subtracted from the average actual tube diameter;

at least one outer ring surrounding said plurality of tubes in a plane about normal to said plurality of tubes; and a plurality of rods having first and second ends wherein each said rod is fixedly secured at its first and second end to one of said outer rings so that each said outer ring has a plurality of said rods secured thereto in a parallel equally spaced relation wherein each of said rods extends between two adjacent rows of said tubes so as to be in supportive contact with each said tube of the two adjacent rows, wherein said rods comprise standard rods and substitute rods wherein each said standard rod has the same desired standard rod diameter and each said standard rod has an actual standard rod diameter wherein the standard rod tolerance is defined as the desired standard rod diameter subtracted from the average actual standard rod diameter, and each said substitute rod has approximately the same substitute rod diameter, and wherein the total tolerance is defined as the sum of the tube tolerance and the standard rod tolerance, wherein, when the total tolerance is a positive number, said substitute rods comprise undersized rods wherein the actual diameter of said undersized rods is less than the desired diameter of said standard rods, and wherein every N-th rod of said plurality of rods comprises one of said undersized rods and all remaining rods comprise said standard rods wherein N is determined by the formula $$N = \frac{(\text{Average Actual Standard Rod Diameter} - \text{Undersized Rod Diameter})}{\text{total tolerance}}$$

wherein N is rounded off to the nearest integer and, alternately, wherein when the total tolerance is a negative number, said substitute rods comprise oversized rods wherein the actual diameter of said oversized rods is greater than the desired diameter of said standard rods, and wherein every N-th rod of said plurality of rods comprises one of said oversized rods and all remaining rods comprise said standard rods wherein N is determined by the formula $$N = \frac{(\text{Average Actual Standard Rod Diameter} - \text{Oversized Rod Diameter})}{\text{total tolerance}}$$

wherein N is rounded off to the nearest integer.

* * * * *